US005333848A

United States Patent [19]

Rubscha

[11] Patent Number: 5,333,848

[45] Date of Patent: Aug. 2, 1994

[54] RETARD FEEDER

[75] Inventor: Robert F. Rubscha, Fairport, N.Y.

[73] Assignee: Xerox Corporation, Stamford, Conn.

[21] Appl. No.: 128,183

[22] Filed: Sep. 29, 1993

[51] Int. Cl.[5] ..... B65H 3/06

[52] U.S. Cl. ..... 271/3.1; 271/117; 271/122; 271/273

[58] Field of Search ..... 271/121, 122, 117, 273, 271/301, 3.1

[56] References Cited

U.S. PATENT DOCUMENTS

| | | | |
|---|---|---|---|
| 3,044,770 | 7/1962 | Breuers | 271/122 |
| 3,108,801 | 10/1963 | Van Dalen | 271/122 |
| 4,368,973 | 1/1983 | Silverberg | 355/35 H |
| 4,801,134 | 1/1989 | Yokoyama | 271/122 |
| 4,928,951 | 5/1990 | Fukui | 271/122 X |
| 5,026,036 | 6/1991 | Takahashi | 271/3.1 |
| 5,039,080 | 8/1991 | Kato | 271/122 |
| 5,158,279 | 10/1992 | Laffey | 271/122 X |

*Primary Examiner*—Richard A. Schacher
*Attorney, Agent, or Firm*—H. Fleischer; J. E. Beck; R. Zibelli

[57] ABSTRACT

An apparatus which advances and separates sheets from a stack of sheets. The apparatus includes an operator pivotable frame having a nudger roll and a feed roll mounted thereon. In operation, the feed roll engages a retard roll. The retard roll is coupled through a gear to a slip clutch. In the event a single sheet is advanced by the nudger roll to the nip defined by the feed roll and retard roll, the frictional force between the sheet and retard roll is sufficient to overcome the torque applied on the retard roll by the slip clutch and the retard roll rotates in one direction permitting the sheet to pass through the nip. Alternatively, in the event multiple sheets are being advanced by the nudger roll into the nip, the frictional force is reduced and the retard roll rotates in the opposite direction under the torque applied thereon by the slip clutch driving the sheets back toward the stack from which they originally advanced. In the event a jam occurs, the frame supporting the nudger roll and feed roll may be pivoted by the operator to an inoperative position separating the feed roll from the retard roll permitting easy access for removal of jammed sheets.

1 Claim, 2 Drawing Sheets

RETARD FEEDER

The present invention relates generally to an electrophotographic printing machine, and more particularly concerns an improved active retard feeder for advancing and separating documents or copy sheets.

Generally, an electrophotographic printing machine includes a photoconductive member which is charged to a substantially uniform potential to sensitize the surface thereof. The charged portion of the photoconductive surface is exposed to a light image of an original document being reproduced. This records an electrostatic latent image on the photoconductive member corresponding to the information at areas contained within the original document. After the electrostatic latent image is recorded on the photoconductive member, a developer mix is brought into contact therewith. This forms a powder image on the photoconductive member which is subsequently transferred to a copy sheet. Finally, the copy sheet is heated to permanently affix the powder image thereto in image configuration.

In today's high speed electrophotographic printing machines, the automatic handling of documents and copy sheets is very critical to machine reliability. Not only must each copy sheet and document be handled without marring or destroying the sheet but, also, misfeeds and multiple feeds must also be prevented. Furthermore, the customer, today, is requiring that there be significant reductions in noise in the printing machines. This requires that loud vacuum feeders be replaced with quiet, less expensive retard feeders. This makes the use of active friction retard feeders more attractive. However, previously active friction retard feeders had problems when sheet or document jams had to be cleared. In the past, the operator had to pull the document or copy sheet through the closed feed nip in order to remove the jammed sheet or document from the feeder unit. The closed nip inhibits jam clearance and may also damage the document by smearing, creasing or even tearing it. Furthermore, in the case of automatic document handling unit, the unit must be capable of handling original documents having information on not only one side but both sides since duplex, as well as simplex, copying is required in the present day printing machine. Today's automatic document handling unit makes pre-collation copying feasible. In pre-collation copying, any desired number of pre-collated copy sets may be made by making a corresponding number of recirculations of the documents in collated order past the imaging station and reproducing each document as it is circulated. However, in order to reduce the noise in today's printing machine, it is necessary to replace the current generation of vacuum transport systems used for document handling units and copy sheet feeders with active retard feeders. These active retard feeders must be capable of having jams removed simply therefrom while preventing multiple sheet feeds. Various approaches have been devised to improve document and copy sheet handling units. The following disclosure may be relevant to various aspects of the present invention:

U.S. Pat. No. 4,368,973, Patentee: Silverberg, Issued: Jan. 18, 1983.

The relevant portions of the foregoing patent may be briefly summarized as follows:

U.S. Pat. No. 4,368,973 discloses a recirculating document handling unit in which successive uppermost documents are fed from a stack to an imaging station.

After imaging, the documents are returned to the bottom of the stack. Successive uppermost sheets of the stack of documents are advanced by a vacuum belt feeder to a vacuum belt transport which advances the document to the platen. At the platen, the original document is positioned face down and illuminated to expose the charged portion of the photoconductive surface. A vacuum belt transport then returns the imaged document to the bottom of the stack of documents supported on a vacuum belt support. The vacuum belt feeder is mounted pivotably on the frame of the document handling unit. In this way, the vacuum belt feeder is pivotable to a position remote from the vacuum belt support system. This facilitates loading a stack of documents onto the vacuum belt support system. After the stack of documents has been loaded on the vacuum belt support system, the vacuum belt feeder is returned to its operative position. In this position, the vacuum belt feeder is located closely adjacent to the uppermost sheet of the stack of documents disposed on the vacuum belt support system.

In accordance with one aspect of the present invention, there is provided an apparatus for advancing and separating sheets from a stack of sheets. The apparatus includes a movable frame with a nudger member mounted movably on the frame. The nudger member, in an operative position, is in engagement with a sheet of the stack of sheets to advance the sheet therefrom. A feed member is mounted movably on the frame. The feed member, in the operative position, is in engagement with a retard member to define a nip therebetween for separating any overlapped sheets reaching the nip. The frame is movable from the operative position to an inoperative position spacing the nudger roll from the sheet of the stack, and the feed roll from the retard member enabling an operator to readily remove jammed sheets.

Pursuant to another aspect of the present invention, there is provided an apparatus for moving documents in a recirculating path from a stack of documents to an imaging station. The apparatus includes means for supporting the stack of documents. Means are provided for advancing documents from the stack thereof to the imaging station. The advancing means comprises a movable frame and a nudger member mounted movably on the frame. The nudger member, in an operative position is in engagement with the document of the stack of documents to advance the document from the stack thereof. A feed member is mounted movably on the frame. The feed member, in the operative position is in engagement with a retard member to define a nip therebetween for separating any overlapped documents reaching the nip. The frame is movable from the operative position to an inoperative position spacing the nudger roll from the document of the stack of documents and the feed roll from the retard member enabling an operator to readily remove jammed documents. Means are provided for returning the document from the imaging station to the stack of documents being supported by said supporting means.

Pursuant to still another feature of the present invention, there is provided an apparatus for advancing and separating sheets moving away from a stack of sheets. The apparatus includes a first member adapted to move bi-directionally. A second member engages the first member to define a nip therebetween for receiving sheets moving away from the receiving sheets moving away from the stack. A controller, responsive to a plurality of sheets entering the nip, moves the first member in a first direction to move the sheets away from the nip toward the stack of sheets. The controller, responsive to a single sheet entering the nip, permits the first member to move in a second direction, opposite to the second direction, to move the sheet through the nip away from the stack of sheets.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
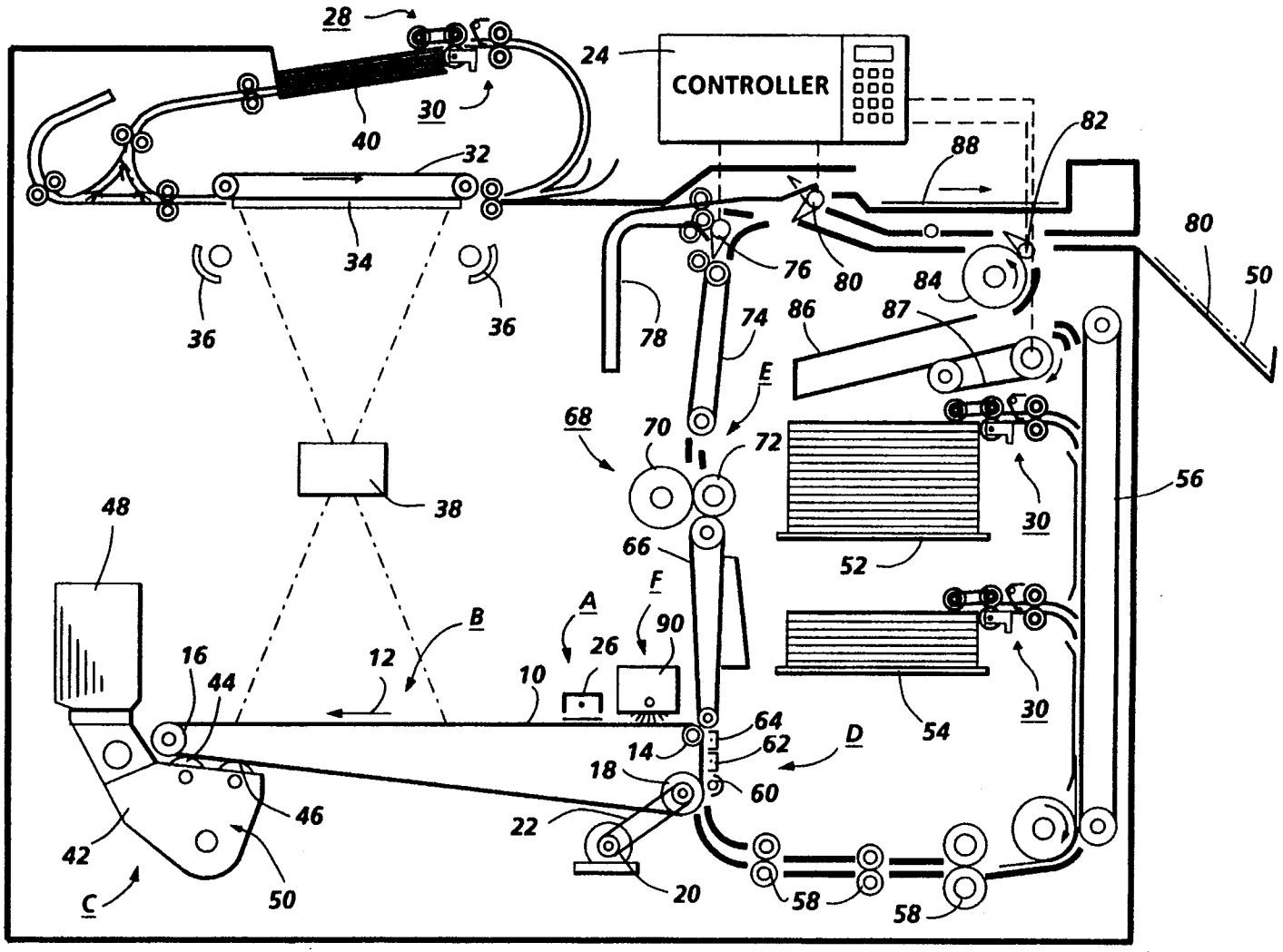
FIG. 1 is a schematic, elevational review showing an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the retard feeder of the present invention therein. It will become apparent from the following discussion that the retard feeder is equally well suited for use in a wide variety of electrostatographic printing machines and is not necessarily limited in its application to the particular embodiment shown herein. For example, as described hereinafter the active retard feeder of the present invention may be used in a document handling unit and a copy sheet feeder.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a belt 10 having a photoconductive surface comprising an anti-curl layer, a supporting substrate layer and an electrophotographic imaging single layer or multiple layers. The imaging layer may contain homogeneous, hetrogeneous, inorganic or organic compositions. Preferably, finely divided particles of the photoconductive inorganic compound are dispersed in an electrically insulating organic resin binder. Typically, photoconductive particles include metal free phthalocyanine, such as copper phthalocyanine, quinacridones, 2,4-diamino-triazines and polynuclear aromatic quinines. Typical organic resin binders include polycarbonates, acrylate polymers, vinyl polymers, cellulose polymers, polyesters, polysiloxanes, polyamides, polyurethanes, epoxies, and the like. Other well known electrophotographic imaging layers include amorphous selenium, halogen dope-di-morphous selenium, amorphous selenium alloys (including selenium arsenic, selenium tellurium, and selenium arsenic antimony), and halogen dope-selenium alloys, cadmium sulphide, and the like. Generally, these inorganic photoconductive materials are deposited as a relatively homogeneous layer. The anti-curling layer may be made from any suitable film forming a binder having a flexible thermal plastic resin with reactive groups which will react with reactive groups on a coupling agent molecule. Typical thermal plastic resins include polycarbonates, polyesters, polyurethanes, acrylic polymers, vinyl polymers, cellulose polymers, polysiloxanes, polymides, polyurethanes, epoxies, Nylon, polybutadiene, natural rubber, and the like. A film forming binder of polycarbonate resin is particularly preferred because of its excellent adhesion to adjacent layers and transparency to activating radiation. The substrate layer may be made from any suitable conductive material such as Mylar. Another well known conductive material can be used in the substrate layer is aluminum. Belt 10 moves in the direction of arrow 12 to advance successive portions of the photoconductive surface sequentially through the various processing stations disposed about the path of movement thereof.

Belt 10 is entrained about stripping roller 14, tensioning roller 16, and drive roller 18. Stripping roller 14 is mounted rotatably so as to rotate with belt 10. Tensioning roller 16 is resiliently urged against belt 10 to maintain belt 10 under the desired tension. Drive roller 18 is rotated by a motor 20 coupled thereto by suitable means, such as a belt drive 22. A controller 24 controls the motor 20 in a manner known to one skilled in the art to rotate the roller 18. As the drive roller 18 rotates, it advances belt 10 in the direction of arrow 12.

Initially, a portion of the photoconductive surface passes through charging station A. At charging station A, a corona generating device, indicated generally by the reference numeral 26, charges the photoconductive surface to a relatively high, substantially uniform potential.

Next, the charged portion of the photoconductive surface is advanced to imaging station B. Imaging station B includes a document handling unit incorporating the active retard feeder of the present invention therein. The document handler unit, indicated generally by the reference numeral 28, sequentially feeds successive original documents from a stack of original documents placed by the operator face up in the normal forward collated order on the document handling and supporting tray. The uppermost sheet of the stack of documents is placed closely adjacent to the retard feeder, indicated generally by the reference numeral 30. Retard feeder 30 advances the topmost sheet from the stack of documents to transport belt 32. Transport belt 32 advances the original document to platen 34. At platen 34, the original document is positioned face down. Lamps 36 illuminate the original document on transparent platen 34. The light rays reflected from the original document are transmitted through lens 38. Lens 38 forms a light image of the original document which is projected onto the charged portion of the photoconductive surface of belt 10 to selectively dissipate the charge thereon. This records an electrostatic latent image on the photoconductive surface which corresponds to the informational areas contained within the original document. Transport belt 32 then returns the image document to the bottom of the stack of documents supported on tray 40. A document handler unit of this type exclusive of the active retard feeder of the present invention is described in U.S. Pat. No. 4,368,973 issued to Silverberg in 1983, the relevant portions thereof being hereby incorporated into the present application. A document handling unit of this type provides for 1-N operation. The unit controls restacking. Since the top document retard feeder is employed, the unit is less constrained, more reliable and quieter. The detailed structure and operation of retard feeder 30 will be described hereinafter with reference to FIGS. 2 and 3.

After imaging, belt 10 advances the electrostatic latent image recorded on the photoconductive surface to development station C. At development station C, a magnetic brush developer unit, indicated generally by the reference numeral 42, advances the developer material into contact with the electrostatic latent image recorded on photoconductive surface of belt 10. Preferably, a magnetic brush development unit 42 includes two magnetic brush developer rollers 44 and 46. These rollers each advance developer material into contact with the latent image. Each developer roller forms a brush comprising carrier granules and toner particles. The latent image attracts the toner particles from the carrier granules, forming a toner powder image on the photoconductive surface of belt 10. As successive latent images are developed, toner particles are depleted from developer unit 42. A toner powder dispenser 48 is arranged to furnish additional toner particles to developer housing 50 for subsequent use by the development system. The toner particle dispenser stores a supply of toner particles which are subsequently dispensed into the developer housing to maintain the concentration of toner particles therein substantially uniform. After the latent image is developed with toner particles to form a toner powder image on the photoconductive surface of belt 10, belt 10 advances the toner powder image to transfer station D.

At transfer station D, a copy sheet is moved into contact with the toner powder image recorded on the photoconductive surface of belt 10. The copy sheets are fed from either trays 52 or 54. Each of these trays has a stack of sheets thereon. The retard feeder 30 is also used to advance the top most sheet from the stack. Conveyor 56 receives the sheet advanced from the respective feed tray by retard feeder 30 and advances it to feed rolls 58. Feed rolls 58 advance the sheet to transfer station D. Prior to transfer, lamp 60 illuminates the toner powder image adhering to the photoconductive surface of belt 10 to reduce the attraction therebetween. Thereafter, a corona generating device 62 sprays ions onto the back side of the copy sheet. The copy sheet is charged to the proper magnitude and polarity so that the copy sheet is tacked to the photoconductive surface of belt 10 and the toner powder image attracted thereto. After transfer, a corona generating device 64 charges the copy sheet to the opposite polarity to detack the sheet from belt 10. Conveyor 66 advances the copy sheet to fusing station E.

Fusing station E includes a fuser assembly, indicated generally by the reference numeral 68, which permanently affixes the transferred toner powder image to the copy sheet. Preferably, fuser assembly 68 includes heated fuser roller 70 and back-up roller 72 with the powder image on the copy sheet contacting fuser roller 70. The back-up roller 72 is cammed against the fuser roller 70 to provide the necessary pressure to permanently affix the toner powder image to the copy sheet. After fusing, conveyor 74 advances the copy sheet to gate 76. Gate 76 functions as an inverter selector. Depending upon the position of gate 76, the copy sheet will either be deflected into sheet inverter 78, or by pass inverter 78 and be fed directly into a second decision gate 80. Those copies which by pass inverter 78 are inverted so that the image side, which has been transferred and fused, is face up at this point. However, if inverter path is selected, the opposite is true, i.e. the last printed face is down. Decision gate 80 then either deflects the sheet directly into an output tray 82 or deflects the sheets into a transport path which carries them on without inversion to a third decision gate 82. Gate 82 either passes the copy sheets directly on without inversion into the output path of the printing machine or deflects the sheets into a duplex inverting roller transport 84. Inverting roller 84 inverts and stacks the sheets to be duplexed in duplex tray 86, when required by gate 82. Duplex tray 86 provides buffer storage for those copies which have been printed on one side and on which an image will be printed subsequently on the opposed side. Due to the sheet inverting by roller 84, these copy sheets are stacked in duplex tray 86 face down. They are stacked in duplex 86 on top of one another in the order in which they are initially copied. In order to complete duplex copying, the copy sheets in duplex tray 86 are fed, in seriatim by bottom sheet feeder 88 back to transfer station D by conveyor 56 and transport rollers 58. At transfer station E, the second or opposed side of the copy sheet has a toner powder image transferred thereto. The duplex copy sheets are then fed out through the same path through fusing station E past inverter 78 to be stacked in tray 88 for subsequent removal therefrom by the machine operator.

Invariably, after the copy sheet is separated from the photoconductive surface of belt 10 at transfer D, some residual particles remain adhering thereto. These residual particles are removed from the photoconductive surface at cleaning station F which includes a rotatably mounted fibrous brush 90 in contact with the photoconductive surface. The particles are cleaned from the photoconductive surface by the rotation of the brush in contact therewith. Subsequent to cleaning, a discharge lamp (not shown) floods the photoconductive surface with light dissipate any residual electrostatic charge remaining thereon prior to the charging thereof for the next cycle.

Controller 24 is preferably a programmable microprocessor which controls all of the machine steps and functions heretofor described, including the operation of document handling unit 28 and the associated retard feeder 30 thereof. In addition, the controller controls the document, copy sheets, gates, feeder drives, etc.. Controller 24 also provides for storage and comparison of the counts of the copy sheets, the number of documents recirculated in a document set and the number of copy sets selected by the operator through the switches, time delays, jam, correction control, etc.. The control of the retard feeder may be accomplished by activating it appropriately through signals from the controller in response to simple program commands from switch inputs from the counsel buttons selected by the operator. Alternatively, the movement of the retard feeder may also be controlled automatically in response to the sensing of a sheet jam or multi-sheet feed in either or both the sheet feeders and document handling unit. Exemplary control systems for use in electrophotographic printing machines are described in U.S. Pat. No. 4,062,061 issued Dec. 6, 1977 to Batchelor et al., U.S. Pat. No. 4,123,155 issued Oct. 31, 1978 to Upert, U.S. Pat. No. 4,125,325 issued Nov. 14, 1978 to Betchler et al., and U.S. Pat. No. 4,144,550 issued Mar. 13, 1979 to Donohue et al., the relevant portions of the foregoing patents being incorporated into the present application.

It is believed that foregoing description is sufficient for purposes of the present application to illustrate the general operation of an electrophotographic printing machine incorporating the retard feeder of the present invention therein.

Figure 2:
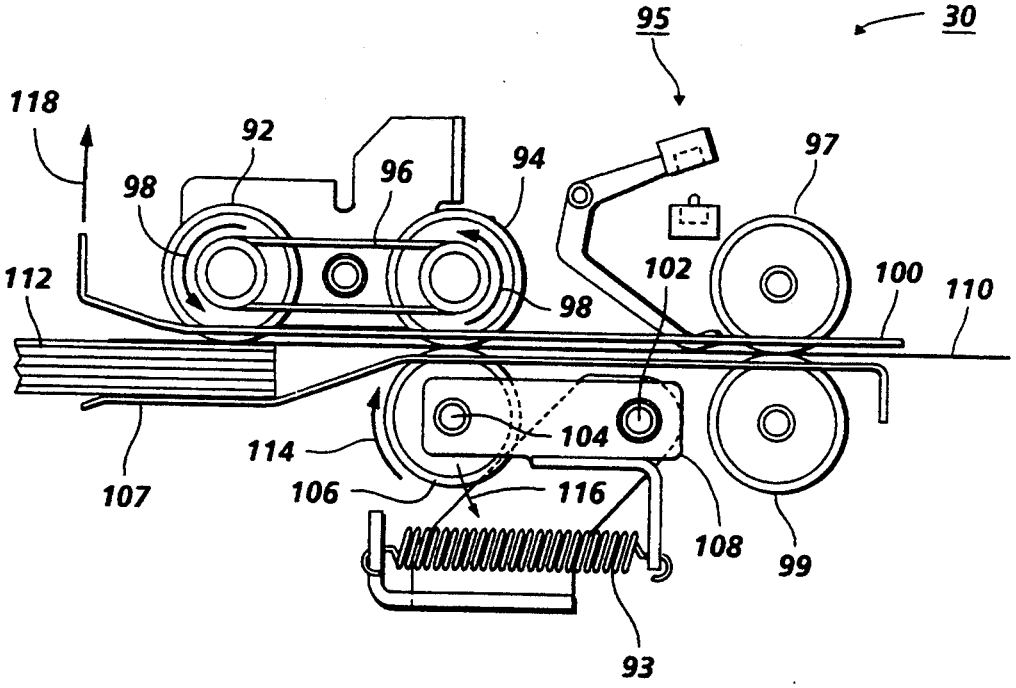
FIG. 2 is an enlarged, schematic, elevational view showing the retard feeder used in the FIG. 1 printing machine in the operative position.

Referring now to FIG. 2, there is shown retard feeder 30 in the operative position. As shown thereat, retard feeder 30 includes a nudger roll 92 and a feed roll 94. A drive belt 96 couples nudger roller 92 with feed roll 94. A motor (not shown) rotates feed roll 94 in the direction of arrow 98. As feed roll 94 rotates, belt 96 drives nudger roll 92 in the direction of arrow 98 as well. Both nudger roll 92 and feed roll 94 are mounted on frame 100. Frame 100 is adapted to pivot about a pivot rod located in Frame 107. Retard roller 106 is spring loaded by spring 93 about pivot shaft 102 providing both normal force and proper location for feed roll 94. Arm 108 is pivotably mounted on shaft 102. Retard roller 106 and gear assembly 104 are mounted on arm 108. Shaft 102 is mounted on frame 107. The frame 107 is an extension of the tray supporting the sheets or documents. Gear assembly 104 is coupled to retard roll 106. Gear assembly 104 has a slip clutch associated therewith. In normal operation, i.e. when a single sheet is advanced, nudger roller 92 advances the sheet 110 from stack 112 into the nip defined by feed roll 94 and retard roll 106. Feed roll 94 and retard roll 106 are in engagement with one another to define this nip. As feed roll 94 rotates in the direction of arrow 98, the advancing sheet 110 passes into the nip. The friction between the document and retard roll 106 is sufficient to overcome the torque of the slip clutch on retard roll 106 through gear assembly 104 causing retard roller 106 to rotate in the direction of arrow 114 allowing the document or sheet to be advanced through the nip. In the event a multiple number of sheets or documents are transported into the nip from stack 112 by nudger roll 92, the frictional force is significantly lower than when a single sheet is transported thereto. Under these circumstances, the frictional force is not sufficient to overcome the torque of the slip clutch on retard roll 106. Under these circumstances, retard roll 106 rotates in the direction of arrow 116 pushing the documents or sheets in the nip back toward stack 112.

Figure 3:
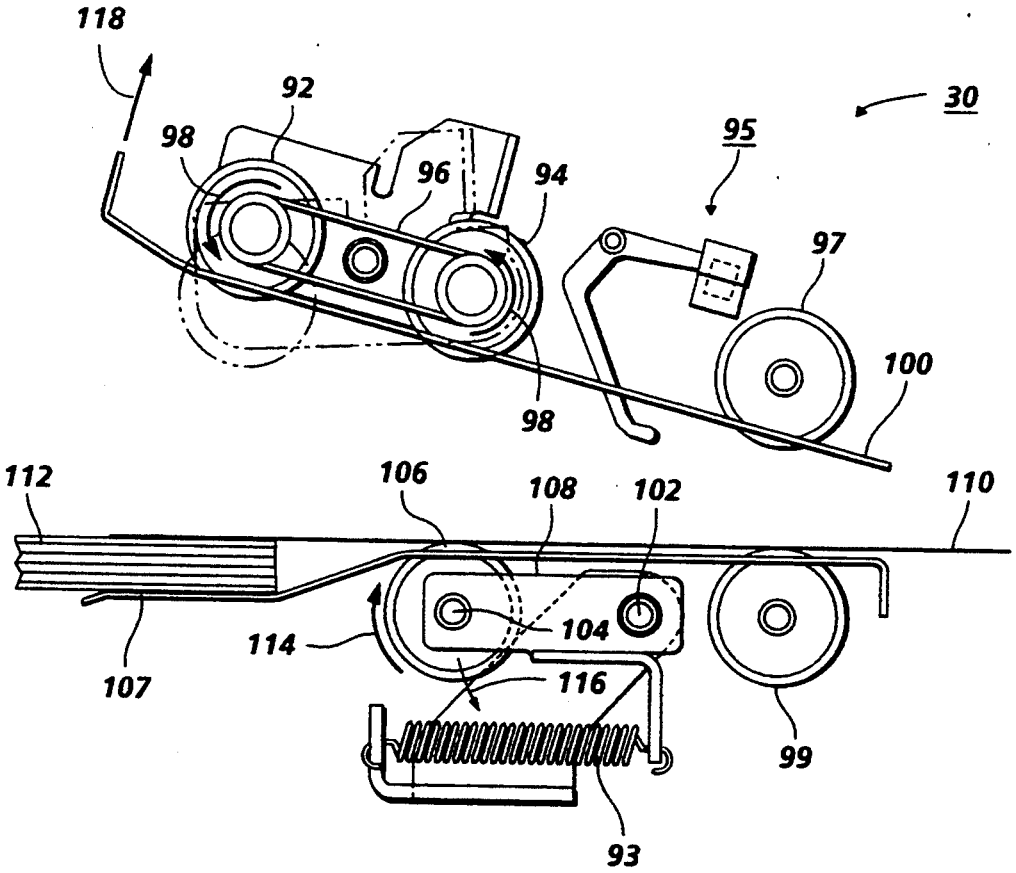
FIG. 3 is an enlarged, schematic, elevational view showing the FIG. 2 retard feeder in the inoperative position.

Turning now to FIG. 3, in the event jam detector 95 detects a sheet jam, frame 100 is pivoted in the direction of arrow 118 separating feed roll 94 from retard roll 106 and nudger roll 92 from stack 112 enabling the machine operator to remove sheet 110 therefrom. After the jam is cleared, the operator pivots frame 100 in a direction opposite to that of arrow 118 so as to place feed roll 94 in engagement with retard roll 106 and nudger roll 92 in engagement with the top most sheet to restore the retard feeder to the operative condition. Frame 100 may be normally positioned in the operative position under the influence of gravity or by a spring resiliently urging frame 100 to pivot in a direction opposite to arrow 118 until retard roll 106 and feed roll 94 are in engagement with one another. After the sheet is advanced through the nip defined by retard roll 106 and feed roll 94, takeaway rolls 97 and 99 continue to advance the sheet along the sheet path.

In recapitulation, it is clear that the improved retard feeder of the present invention provides a system wherein the feed roll may be separated from retard roll to enable jam sheets to be removed therefrom. Furthermore, the retard roll rotates in one direction when a single sheet is being advanced through the nip defined by the feed roll and retard roll and in the opposite direction when multiple sheets are being advanced through the nip. In this way, multiple sheets are returned to the stack while a single sheet is advanced in the desired direction.

It is, therefore, evident that there has been provided in accordance with the present invention a retard feeder which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

I claim:

1. An apparatus for moving documents in a recirculating path from a stack of documents to an imaging station, including:

means for supporting the stack of documents;

means for advancing documents from the stack thereof to the imaging station, said advancing means comprising a movable frame, a nudger roll mounted rotatably on said frame, said nudger roll in an operative position, being in engagement with a document of the stack of documents to advance the documents from the stack thereof, a rotatably mounted retard roll, and a feed roll mounted rotatably on said frame, said feed roll, in the operative position, being in engagement with said retard roll to define a nip therebetween for separating any overlapped documents reaching the nip, said frame being movable from the operative position to an inoperative position spacing said nudger roll from the document of the stack documents and said feed roll from said retard roll enabling an operator to remove jammed sheets, means for resiliently urging said retard roll to pivot toward said feed roll, means for applying a torque on said retard roll of a magnitude and direction that rotates said retard roll in a first direction in response to a plurality of documents entering the nip to move the document toward the stack and permits said retard roll to rotate in a second direction opposite to the first direction, in response to a document entering the nip to move the document away from the stack of documents, said applying means comprises a gear coupled to said retard roll, and a slip clutch coupled to said gear to prevent said retard roll from rotating if a plurality of documents pass through the nip and enable said retard roll to rotate if a single document passes through the nip; and means for returning the document from the imaging station to the stack of documents being supported by said supporting means.

* * * * *